US009242331B2

(12) United States Patent
Elek et al.

(10) Patent No.: US 9,242,331 B2
(45) Date of Patent: Jan. 26, 2016

(54) ELECTRIC SHARPENER FOR CERAMIC AND METAL BLADES

(71) Applicant: EDGECRAFT CORPORATION, Avondale, PA (US)

(72) Inventors: Bela Elek, Wilmington, DE (US); George C. Jensen, Newark, DE (US); Daniel D. Friel, Jr., Kennett Square, PA (US); Samuel Weiner, Wilmington, DE (US)

(73) Assignee: Edgecraft Corporation, Avondale, PA (US)

( * ) Notice: Subject to any disclaimer, the term of this patent is extended or adjusted under 35 U.S.C. 154(b) by 0 days.

(21) Appl. No.: 14/645,468

(22) Filed: Mar. 12, 2015

(65) Prior Publication Data

US 2015/0258651 A1 Sep. 17, 2015

Related U.S. Application Data

(60) Provisional application No. 61/952,210, filed on Mar. 13, 2014.

(51) Int. Cl.
*B24B 3/54* (2006.01)
*B24B 9/06* (2006.01)

(52) U.S. Cl.
CPC .. *B24B 3/54* (2013.01); *B24B 9/065* (2013.01)

(58) Field of Classification Search
CPC ..... B24B 3/36; B24B 3/54; B24B 3/58; B24D 15/06; B24D 15/08
USPC ..... 451/45, 259, 262, 267, 349, 548–551; 76/81, 7, 81.8, 82, 86, 87
See application file for complete search history.

(56) References Cited

U.S. PATENT DOCUMENTS

| | | | | |
|---|---|---|---|---|
| 2,137,201 | A * | 11/1938 | Boyer | 75/243 |
| 2,841,926 | A | 7/1958 | Lebus | |
| 4,627,194 | A | 12/1986 | Friel | |
| 4,716,689 | A | 1/1988 | Friel | |
| 4,807,399 | A | 2/1989 | Friel | |
| D303,209 | S | 9/1989 | Friel | |
| D310,620 | S | 9/1990 | Friel | |
| 5,005,319 | A | 4/1991 | Friel | |
| D328,410 | S | 8/1992 | Friel | |
| 5,148,634 | A | 9/1992 | Bigliano | |
| 5,245,791 | A | 9/1993 | Bigliano | |
| 5,611,726 | A | 3/1997 | Friel | |
| D409,891 | S | 5/1999 | Friel | |
| 6,012,971 | A | 1/2000 | Friel | |
| 6,071,181 | A * | 6/2000 | Wightman et al. | 451/192 |
| 6,113,476 | A | 9/2000 | Friel | |
| 6,267,652 | B1 | 7/2001 | Friel | |

(Continued)

OTHER PUBLICATIONS

PCT Search Report and Written Opinion, Jun. 16, 2015.

*Primary Examiner* — George Nguyen
(74) *Attorney, Agent, or Firm* — Drinker Biddle & Reath LLP

(57) ABSTRACT

An electric sharpener for sharpening ceramic blades includes at least one stage. The stage is a finishing station having a sharpening member in the form of a disc which comprises a rigid support having a flexible abrasive matrix which both sharpens and polishes the facet of the ceramic blade. The sharpener may include a pre-sharpening stage for metal blades and a further pre-sharpening stage for ceramic blades. The sharpener also includes a removable guide.

24 Claims, 11 Drawing Sheets

(56) References Cited

U.S. PATENT DOCUMENTS

| | | | | |
|---|---|---|---|---|
| D491,783 | S | 6/2004 | Ikegaki et al. | |
| 6,752,702 | B1 * | 6/2004 | Thompson et al. | 451/177 |
| 6,863,600 | B2 | 3/2005 | Friel | |
| 6,875,093 | B2 | 4/2005 | Friel, Sr. et al. | |
| 6,876,093 | B2 | 4/2005 | Goto et al. | |
| 6,881,137 | B2 | 4/2005 | Friel | |
| 6,997,795 | B2 | 2/2006 | Friel | |
| D542,616 | S | 5/2007 | Elek | |
| D543,430 | S | 5/2007 | Barr | |
| 7,235,004 | B2 | 6/2007 | Friel | |
| 7,287,445 | B2 | 10/2007 | Friel | |
| D567,611 | S | 4/2008 | Elek | |
| 7,452,262 | B2 | 11/2008 | Friel | |
| 7,488,241 | B2 | 2/2009 | Elek | |
| 7,494,403 | B2 | 2/2009 | Friel | |
| 7,517,275 | B2 | 4/2009 | Friel | |
| 7,686,676 | B2 | 3/2010 | Friel | |
| D620,332 | S | 7/2010 | Elek | |
| 8,043,143 | B2 | 10/2011 | Elek | |
| D651,887 | S | 1/2012 | Elek | |
| D652,284 | S | 1/2012 | Elek | |
| D665,647 | S | 8/2012 | Friel | |
| 8,267,750 | B2 | 9/2012 | Friel | |
| D688,545 | S | 8/2013 | Jensen et al. | |
| 8,585,462 | B2 | 11/2013 | Jensen et al. | |
| D699,534 | S | 2/2014 | Elek et al. | |
| 8,678,882 | B1 | 3/2014 | Huber et al. | |
| D705,625 | S | 5/2014 | Huber et al. | |
| 2003/0077990 | A1 | 4/2003 | Li | |
| 2003/0236061 | A1 | 12/2003 | Li | |
| 2004/0077296 | A1 | 4/2004 | Friel et al. | |
| 2007/0077872 | A1 | 4/2007 | Elek et al. | |
| 2008/0261494 | A1 | 10/2008 | Friel et al. | |
| 2009/0209177 | A1 | 8/2009 | Walker | |
| 2009/0233530 | A1 | 9/2009 | Friel | |
| 2009/0298401 | A1 | 12/2009 | Smith et al. | |
| 2013/0165021 | A1 | 6/2013 | Jensen et al. | |
| 2014/0198198 | A1 | 7/2014 | Geissbuehler et al. | |

* cited by examiner

ELECTRIC SHARPENER FOR CERAMIC AND METAL BLADES

CROSS REFERENCE TO RELATED APPLICATION

This application is based on provisional application Ser. No. 61/952,210, filed Mar. 13, 2014, all of the details of which are incorporated herein by reference thereto.

BACKGROUND OF THE INVENTION

Initial research on the process of sharpening ceramic knives as disclosed in U.S. Pat. No. 8,585,462, ('462 Patent), concluded that due to the fracturing of the brittle and fragile ceramic knife edge, to properly develop a factory quality edge, it would require a minimum of three (3) progressive sharpening stages. All of the details of the '462 Patent are incorporated herein by reference thereto.

The (diamond) abrasives grit size would successively be smaller as the ceramic knife is sharpened in stage 1 followed by stage 2 and finished in stage 3. By reducing the grit size of the abrasives in stage 1 and 2 the sizes of the chips in the knife edge would be reduced sufficiently so that the very fine abrasive in stage 3 would be able to remove the remaining small chips and provide a chip free edge.

To further reduce the size of the chips developed in stages 1 and 2, the research concluded that the sharpening process in those two stages should be done by the abrasive moving into the edge, thereby removing ceramic material under compression. By this process the very fine abrasive in stage 3 could remove the small chips. However, to develop a sharp, chip free edge, the direction of the final, finishing stage abrasive would need to move in the opposite direction from stages 1 and 2, thereby moving away from the edge.

Although excellent results could be obtained by this method it provides some drawbacks. First, the requirement to change the direction of the rotation of the abrasive discs presented additional cost, making the manufacture of this sharpener more expensive. Second, the requirement to have at least 3 stages to accomplish the ceramic knife sharpening task, further exacerbated the manufacturing cost. And finally, because of the very small grit size abrasives required in all stages to minimize the chipping process, this sharpener would not be able to sharpen in a reasonably acceptable time, steel knives, which are much more prevalent in homes and stores.

A concern with knife sharpeners, whether for ceramic blades or metal blades, is the difficulty in cleaning or removing swarf created during sharpening from the guide surfaces in the various stages of a sharpener, particularly in the finishing stage.

SUMMARY OF INVENTION

An object of this invention is to provide a sharpener for knives and other cutting instruments which overcomes the above drawbacks.

A further object of this invention is to provide such a sharpener wherein a ceramic knife blade could be sharpened in only two stages.

A still further object of this invention is to provide such a sharpener which could also sharpen metallic blades.

A yet further object of this invention is to provide a blade guide which can be moved from its guiding position when sharpening the blade of a cutting instrument to a non-use position which is accessible for cleaning the guide surfaces.

THE DRAWINGS

DETAILED DESCRIPTION

Figure 1:
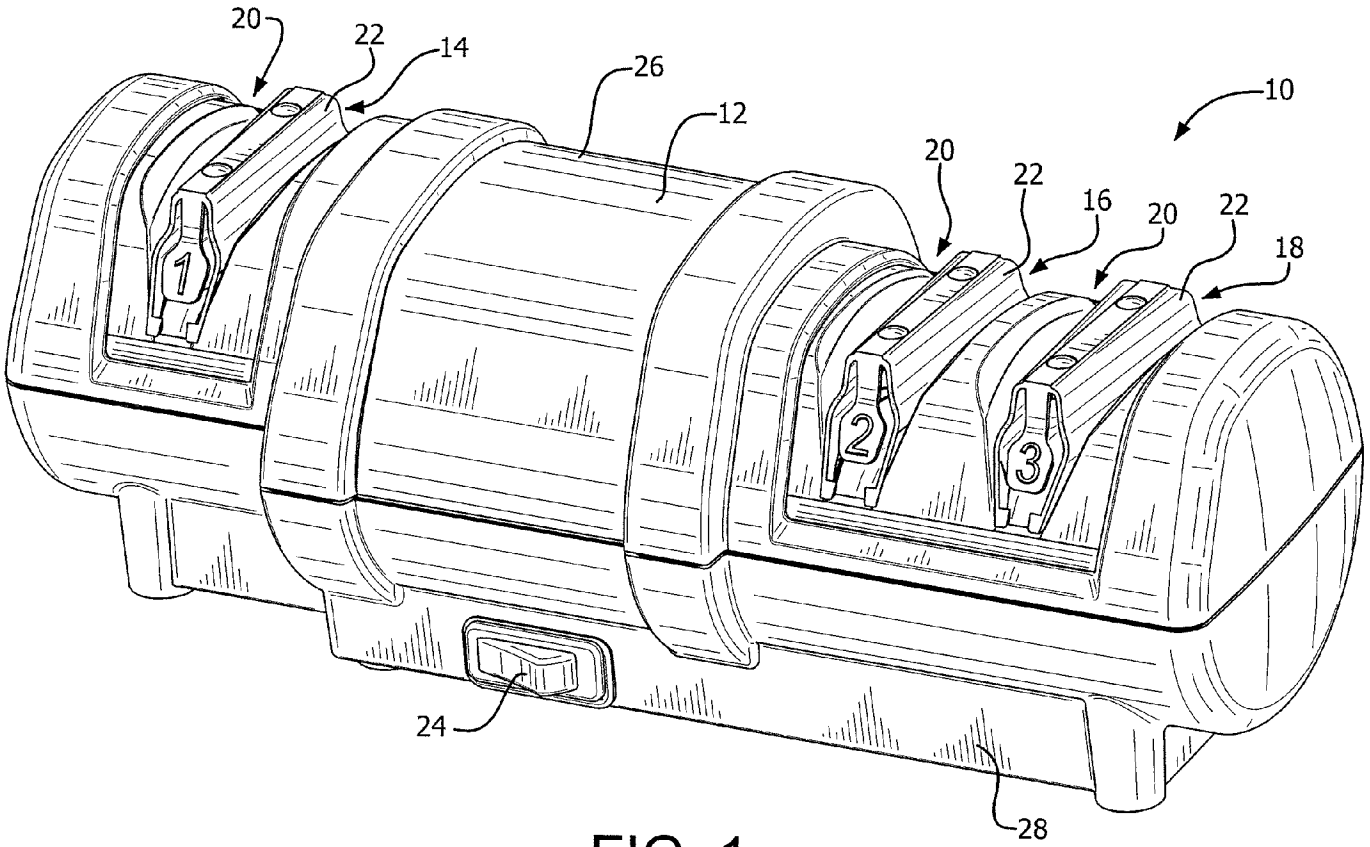
FIG. 1 is an isometric view of a sharpener in accordance with this invention.

Further research, to overcome the drawbacks of the '462 Patent discovered a surprising fact. A new abrasive system that combined a flexible abrasive matrix on a rigid support was able to overcome all of the problems faced by the previously mentioned development described in the '462 Patent.

Central to this new abrasive system is the sharpener's finishing stage abrasive, which combines the functions of both sharpening and polishing. This sharpening/polishing disc constructed with an overall rigid/low-flex reinforcing structure supports a soft, resilient polymer matrix containing ultra-hard abrasive particles. The sharpening/polishing disc's rigid support structure could be manufactured with use of a separate rigid backing plate, an over-molded rigid hub, or by using a substantially thick abrasive matrix material resulting in significant overall rigidity/low-flex of the overall disc structure while preserving the soft, resilient surface of the abrasive matrix. The rigid/low-flex support structure limits the displacement of the overall disc component during sharpening/polishing which affords very precise matching of a blade's edge facets by the matrix abrasive. The soft, resilient abrasive matrix surface allows very gentle polishing of the blade edge while the simultaneous machining of the facet is occurring.

The physical characteristics/specifically the resilience of the polymer matrix/incorporated in the finishing stage (stage 3) of this sharpener were measured using a modified Wilson Rockwell Hardness test, as more fully described in U.S. Pat. Nos. 5,611,726 and 6,012,971. All of the details of these patents are incorporated herein by reference thereto. As described in U.S. Pat. Nos. 5,611,726 and 6,012,971 the Rockwell Hardness test was conducted with a primary load of 60 Kg and recovery load of 10 Kg using a ⅞" diameter steel compressor ball. Experiments were conducted with a variety of loading factors. The measured recovery ranged from 38% to 48%, with the optimal recovery in the range of 40% to 45%.

The abrasive particles used in the abrasive matrix are typically harder than the hardness of ceramic. Best results were obtained using diamond abrasive, but other very hard abrasive particles such as tungsten carbide, silicon carbide, boron carbide, and synthetic rubies or combinations thereof could also be used. Effective grit sizes were found in the range from 230 grit size to 2000 grit size. Best results were achieved using 600 grit size to 1200 grit size.

What this new abrasive system accomplished:

1. Sharpening the blade of ceramic knives or other cutting instruments (e.g. scissors) in 2 stages.
2. Allow the use of more economical and readily available, large abrasive particles, i.e.: larger grit size.
3. Allow for the consistent abrasive direction during the sharpening process in all three stages, thereby reducing cost and complexity.
4. Allow the sharpener to be used as a dual use sharpener for ceramic and metallic (e.g. steel) blades through the use of larger abrasive grit which improves its economic viability in the market place.

Figure 2:
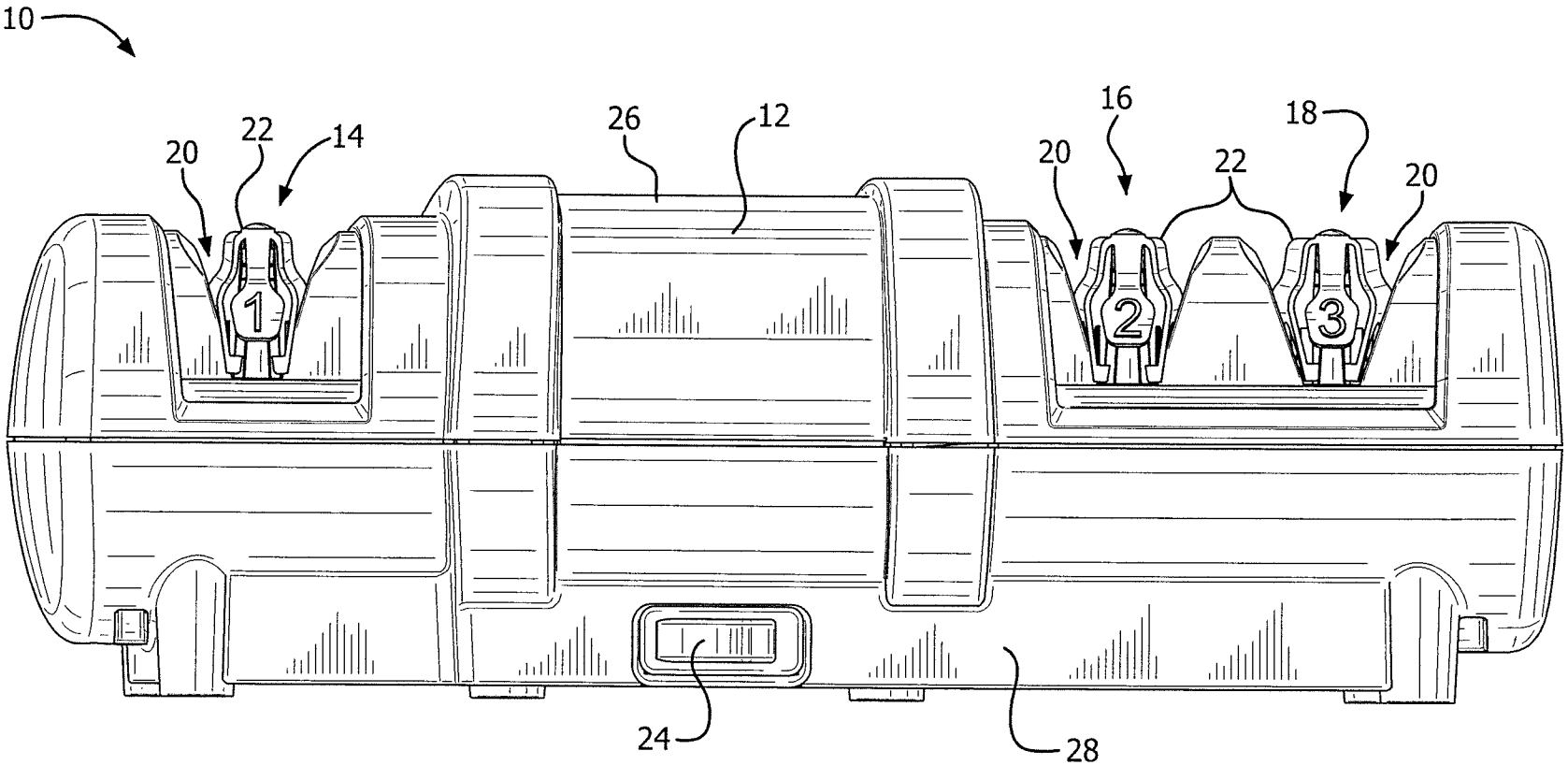
FIG. 2 is a front elevation view of the sharpener of FIG. 1.
Figure 3:
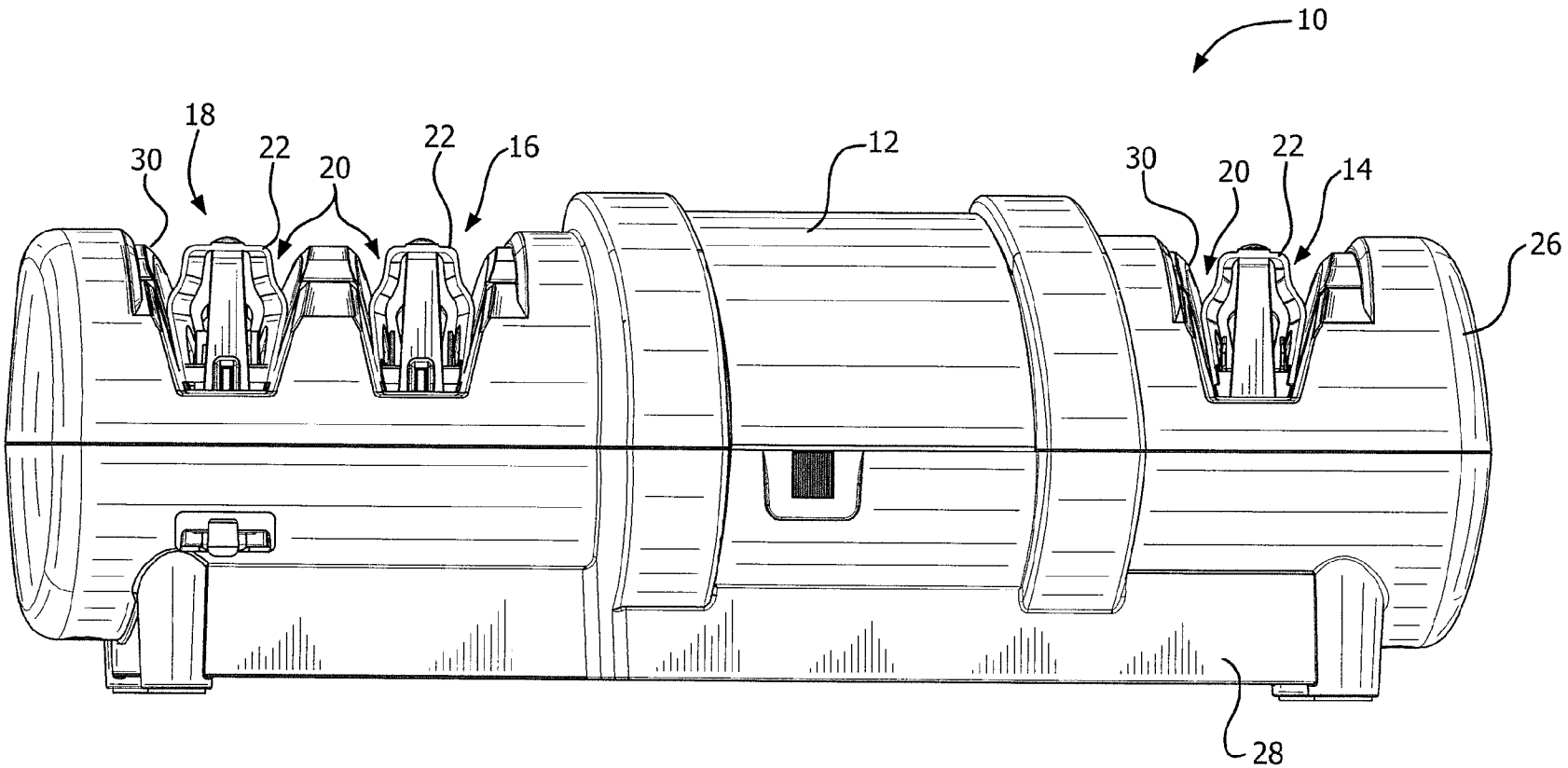
FIG. 3 is a rear elevational view of the sharpener shown in FIGS. 1-2.
Figure 4:
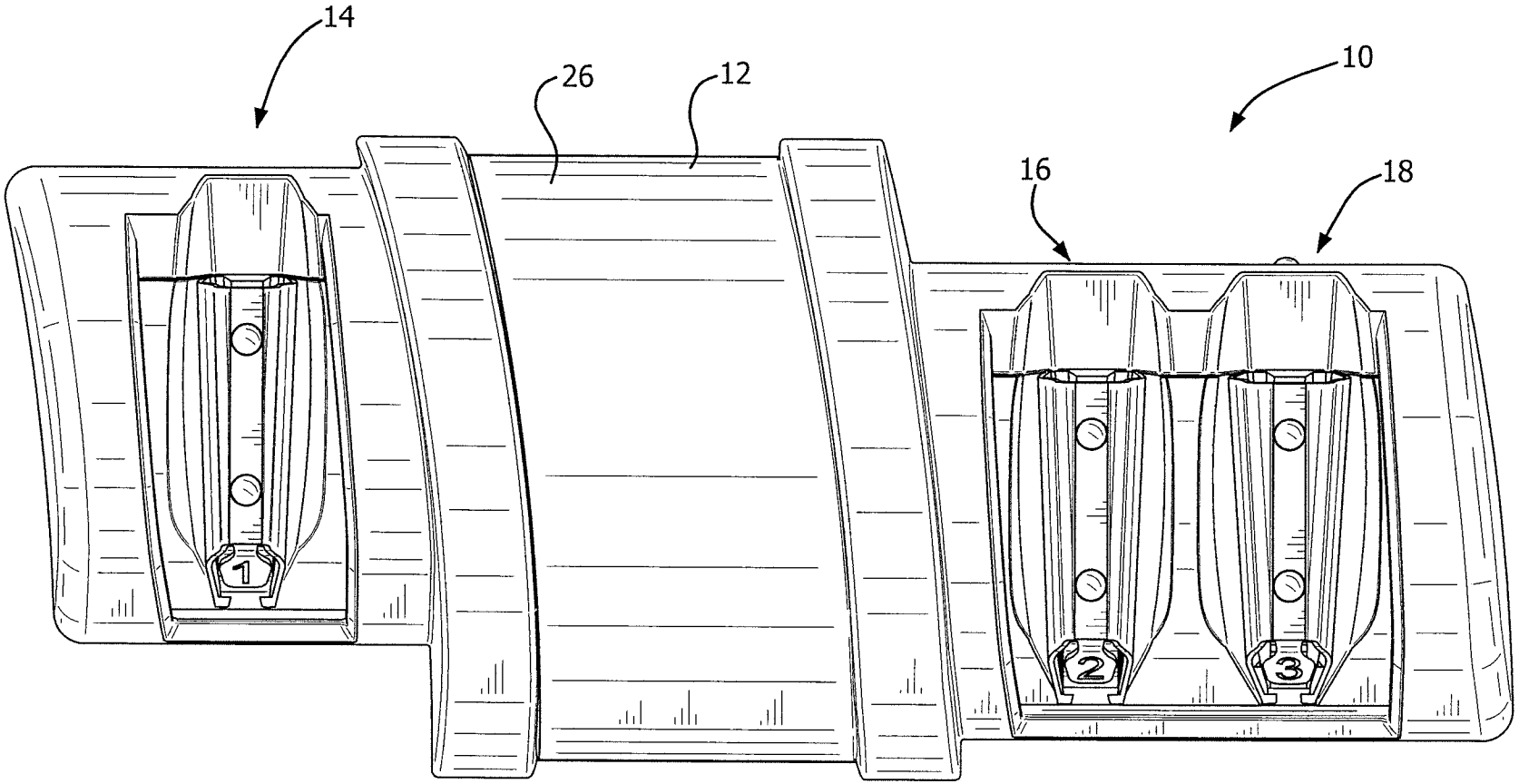
FIG. 4 is a top plan view of the sharpener shown in FIGS. 1-3.

FIGS. 1-2 illustrate a sharpener 10 in accordance with this invention. As shown therein the sharpener 10 has an outer housing 12 and is provided with three stages. Stage 1 designated as 14 is a pre-sharpening stage which is designed for pre-sharpening knives or other cutting instruments with metal blades. Stage 2, designated as 16, is a pre-sharpening stage designed for ceramic blades. Stage 3, designated as 18 is a finishing stage which is designed as a combined sharpening and polishing stage for selectively finishing either a metallic blade pre-sharpened in stage 1 or a ceramic blade pre-sharpened in stage 2. Each stage is provided with a pair of rotatable discs, with guide structure 20 and with a spring 22 between the discs for properly aligning the blade and holding the blade into contact with the rotating disc. Each disc is rotatable by being mounted to a motor driven shaft with a spring mounted around the shaft providing a spring force against the disc. The details of such structure for each of stages 1, 2 and 3 is similar to the '462 patent and to published U.S. application 2009/0233530, all of the details of which are incorporated herein by reference thereto, except for other details which are noted as regards this present invention. The discs are rotated by pressing button 24 which actuates the motor driving the shafts on which the discs are mounted.

Stage 1, as noted, is particularly designed for pre-sharpening metal blades. Preferably the discs in stage 1 have a metal backing and an abrasive surface wherein the abrasive particles are in the range of 100-600 grit size. Where stage 1 is used for sharpening metal knives, the overall included angle of the facet is preferably $24^{0}$-50° with the guide surface on each side of its disc thereby being at an angle of $12^{0}$-25°. More preferably, the total included angle formed in stage $1^{0}$ is 30° with each guide surface being at an angle of 15°. The spring force against the discs in stage 1 is preferably 0.2-1.5 pounds.

In the ceramic sharpener of the '462 patent all of the abrasives in the pre-sharpening stage(s) were too fine to effectively pre-sharpen a metal blade in a reasonable time. In the '462 patent the pre-sharpening stage(s) for ceramic knives required a very fine diamond size to prepare the edge facet for the final stage stropping without causing too much damage. The final stropping stage could not repair the large chips created if large abrasives were used in the pre-sharpening stage(s). This forced the use of very fine diamonds in the pre-sharpening stage(s). The fine diamonds were needed to prepare the ceramic edge facet without causing significantly large chip outs edge prior to moving on to the stropping stage.

With the sharpener 10 of this invention stage 3 is so effective that it can remove fairly significant chips from the ceramic edge. As a result, with this invention only one pre-sharpening stage is needed to prepare the edge for the final facet formation and polishing that occurs in stage 3. With this invention it is possible to use larger diamond grit sizes in one or two pre-sharpening stages without worrying too much about the larger chips that are created. Now that only one pre-sharpening stage is mandatory for ceramic blades, an extra stage is thereby available (within, for example, a total of 3) to tailor especially for metal blades. Thus, metal pre-sharpening stage 1 can be accommodated in the same sharpener 10 that is designed for sharpening ceramic blades. With this invention the new final stage disc can create a final facet with high polish on the metal blade coming out of this single pre-sharpening stage.

Stage 2 is designed for pre-sharpening ceramic blades. Preferably, the discs in stage 2 use abrasives having a grit size of 200-1200. The facet total included angle formed in stage 2 is preferably $24^{0}$-$42^{0}$ which is achieved by having each guide surface at $12^{0}$-$21^{0}$ and more preferably at $28^{0}$ (guide angle 14°). The spring force against the disc in stage 2 is preferably the same as in stage 1.

In the '462 patent, pre-sharpening a ceramic knife required two stages both containing very fine abrasives. Both of these pre-sharpening stages require the use of very small abrasive sizes rotating into the edge to best reduce the chip out size at the edge. As long as the edge chips (leftover from the pre-sharpening stages) were small enough the old stropping disc technology could effectively remove these very small chips resulting in satisfactory final edge sharpness.

The third stage of the present invention is so effective at cutting a facet and also polishing it simultaneously that it is possible to use a larger grit size in the pre-sharpening stage for ceramic knives. Even though the larger abrasive particles (used in the pre-sharpening stage) create larger edge chip outs the stage 3 disc can remove them easily. Preferably, the abrasives in stage 3 are in the range of 180-2,000 grit size. The overall angle in stage 3 is preferably $28^{0}$-50° (14°-25° for each guide surface) and more preferably 34° (17° for the guide surface). The spring force against the discs in stage 3 is preferably 0.2-2.0 pounds and more preferably 0.4-1.1 pounds.

Where stage 1 is used for pre-sharpening traditional European and American metal knives, generally characterized at an angle of about $38^{0}$-40°, the angle of the finishing stage would be appropriately adjusted. This could be done by having the stage 3 guides adjustable in the angle of their guide surfaces to accommodate various style knives. Alternatively, a separate finishing stage could be provided for each style knife.

The new finishing (sharpening/polishing) stage 3 of this invention is so effective that the invention can be practiced with a single stage sharpener/polishing tool as a maintenance sharpener for ceramic blades. Thus, in a broad sense a sharpener of this invention might be a single stage sharpener which does not require a pre-sharpening stage in that it is used as a maintenance sharpener for ceramic knives or other cutting instruments.

Typically, knife sharpeners are designed with a maximum of three stages. The present invention, however, can be practiced with more than three stages, such as four or five stages that could incorporate some of the old technology that would sharpen both metal and ceramic knives or other cutting instruments, although this would add to the expense and size.

In the present invention super hard plating technology is used for the pre-sharpening stages to improve the durability and life of the pre-sharpening discs. This is especially helpful when sharpening the hard ceramic materials.

As is apparent, the present invention can be practiced using only a single stage sharpener which would incorporate the unique sharpening/polishing stage illustrated in the drawings as stage 3. The invention could also be practiced using only two stages, exclusively for ceramic blades wherein the two stages would correspond to stage 2 and stage 3 of sharpener 10. Similarly, the invention could be practiced with the three stage sharpener described above. Further the invention could be practiced with more than three stages as also described above.

FIGS. 1-7 illustrate a preferred practice of this invention which includes the multi-stage sharpener 10 for sharpening both ceramic and metal blades. As shown therein, housing 12 comprises an upper cover 26 and a base 28. The guide structure 20 in each of the stages includes a fixed guide surface 30 which is preferably planar and the spring arm 32 of spring 22. In the illustrated embodiment the spring 22 at each stage is an inverted U so that a pair of spring arms 32 is provided in each of the stages for cooperation with the fixed guide surface 30 in association with the sharpening member or disc in each stage.

Figure 5:
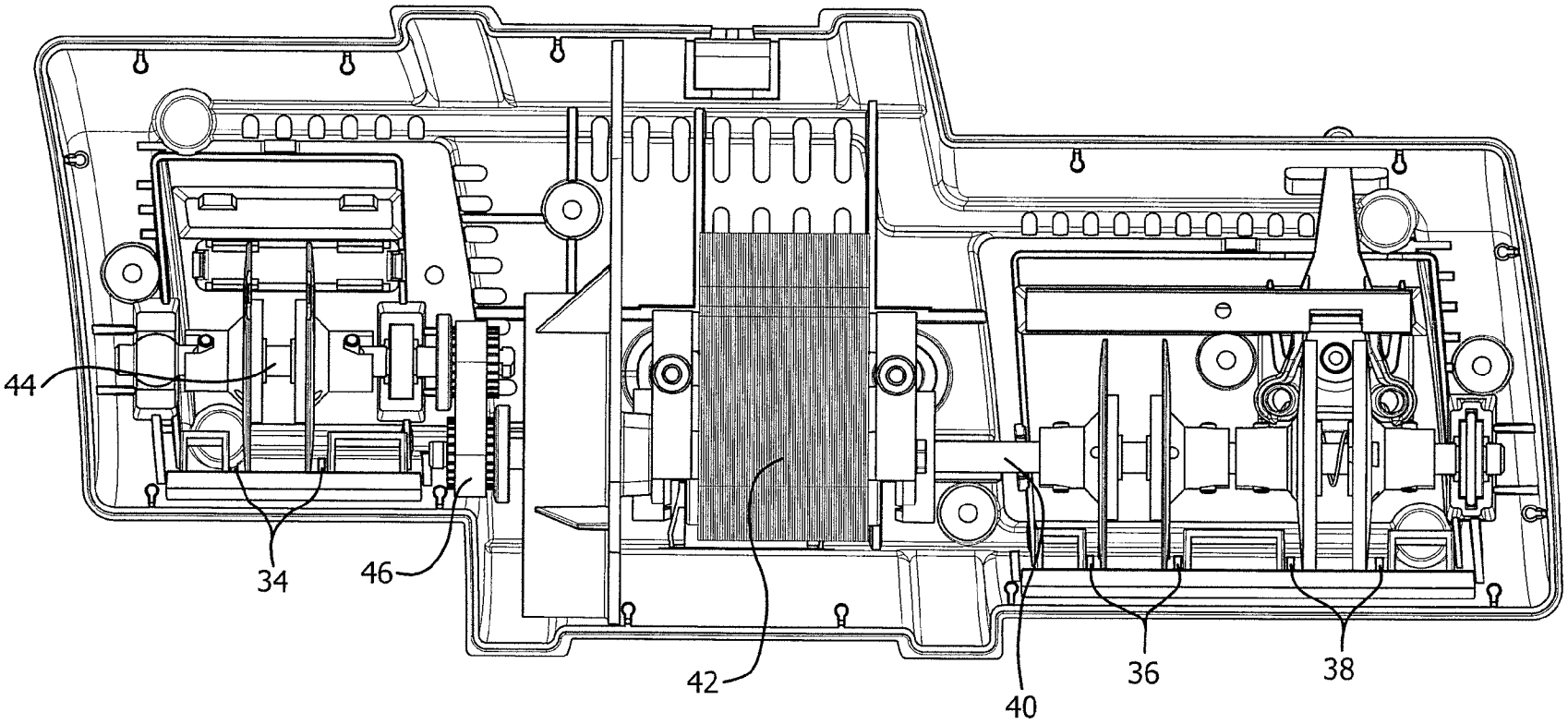
FIG. 5 is a top plan view of the sharpener shown in FIGS. 1-4 with the top cover portion of the housing removed.
Figure 6:
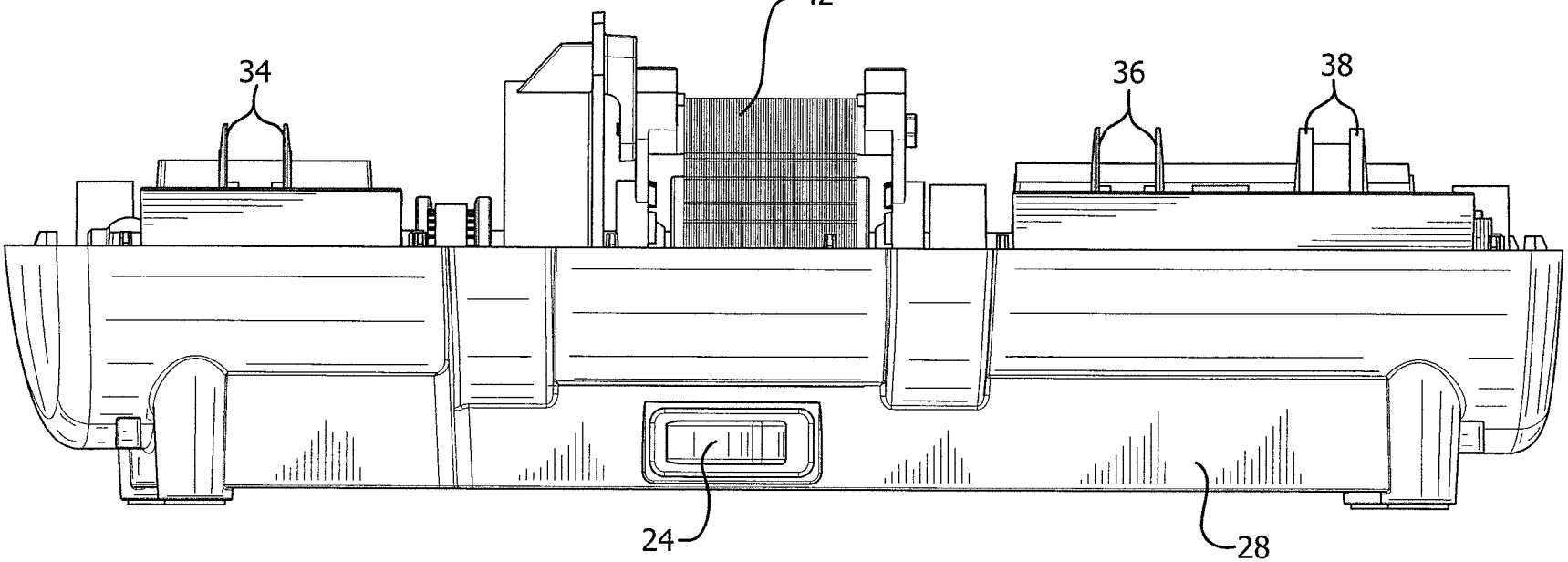
FIG. 6 is a front elevational view of the sharpener shown in FIG. 5.

As illustrated in FIGS. 5-6 (where the upper cover 26 is removed) and as illustrated in other various figures, a pair of sharpening members in the form of rotatable discs is provided in each of the stages. Specifically, stage 1 includes a pair of pre-sharpening discs 34,34. Stage 2 includes a pair of discs 36,36 and the finishing stage 3 includes a pair of discs 38,38. As best shown in FIG. 5 the sets of discs 36,36 and 38,38 are rotated on a common shaft 40 by motor 42. Discs 34,34 in the metal blade pre-sharpening stage are rotated on a separate shaft 44 offset from shaft 40 but rotated by the same motor 42 through pulleys and belt train 46. Having the offset shaft 44 reduces the shaft length and provides for quieter operation. In addition, the separate shafts permit having different RPMs for each shaft.

It is to be understood that the invention can be practiced where all of the discs in all of the stages are mounted on a single shaft eliminating the need for belt and pulley. All of the stages could be on the same side of the motor.

Figure 7:
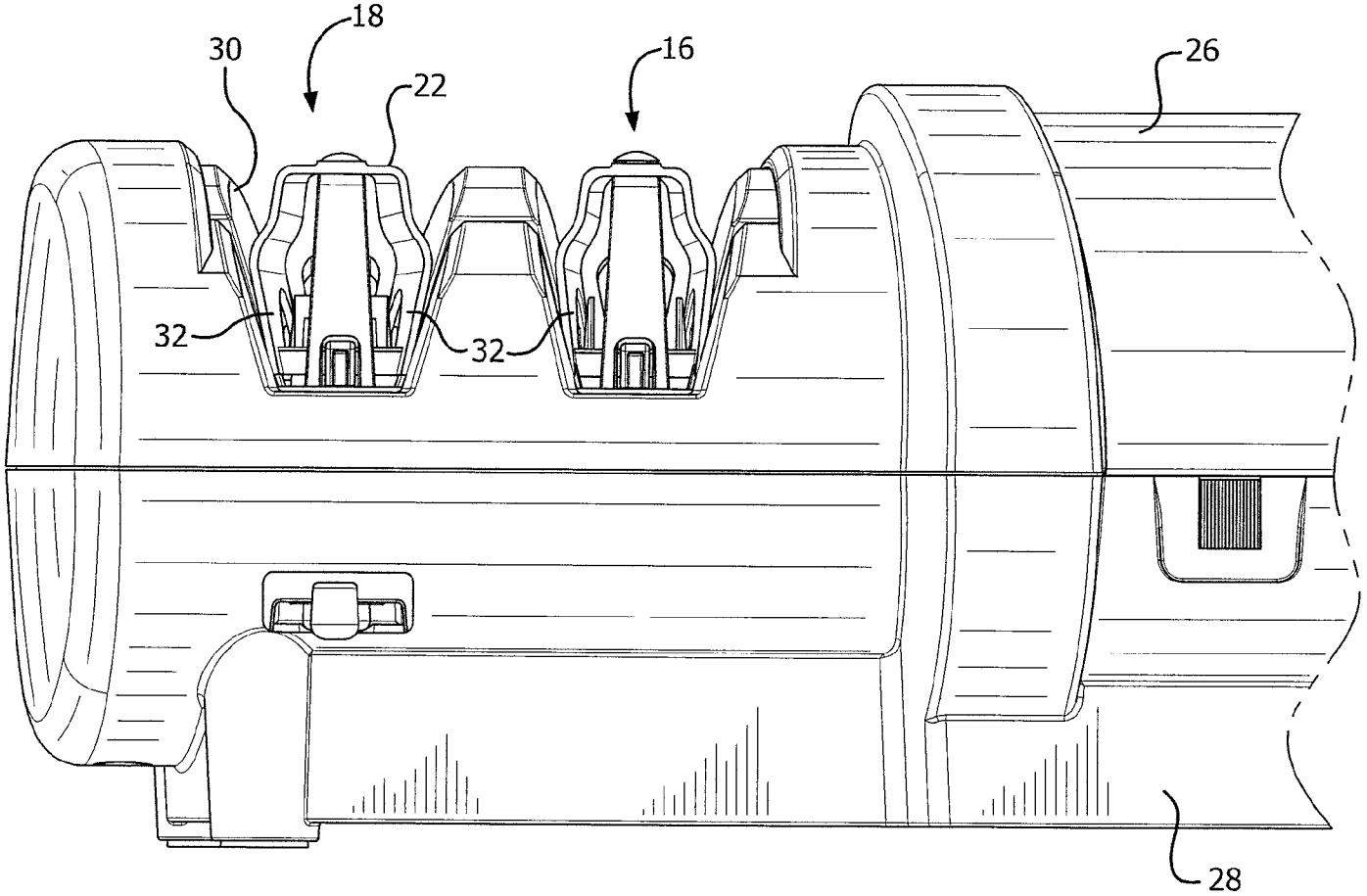
FIG. 7 is a rear elevational view of a portion of the sharpener shown in FIGS. 1-6.
Figure 7A:
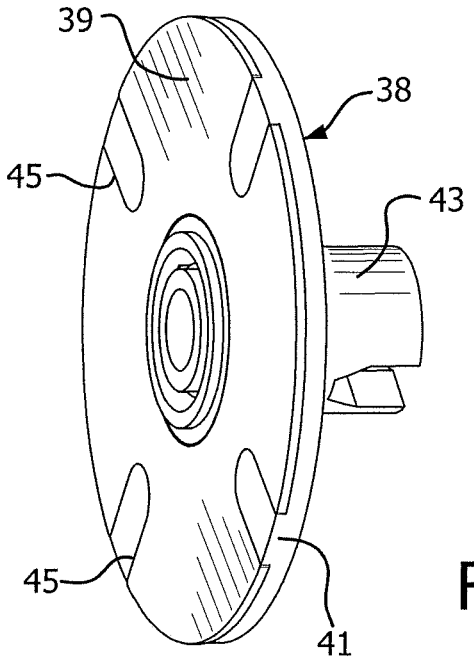
FIGS. 7A and 7B are isometric views of alternate finishing stage discs.
Figure 7B:
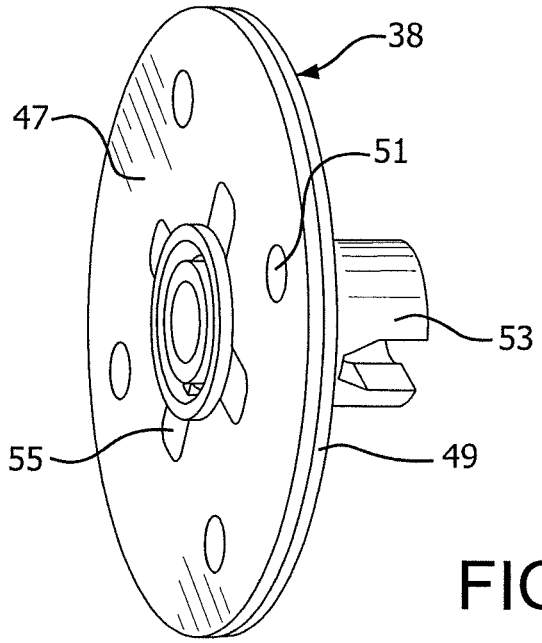

FIGS. 7A and 7B illustrate possible disc structures for the discs 38,38 in the finishing stage. As illustrated, the combination rigid support and flexible abrasive matrix is formed by a metal support 39 which is the backing for abrasive material 41. The disc 38 is mounted to shaft 40 by molded hub 43. As shown, abrasive material 41 interlocks with support 39 at cutouts 45.

In FIG. 7B a plastic hub support or backing 47 interlocks with abrasive material 49 through holes 51 and abrasive material 49 interlocks with molded hub 53 through cutouts 55.

The combination rigid support and flexible abrasive matrix may take other forms. Instead of a two layer combination, such as in FIGS. 7A and 7B, the combination could be a single layer which is thick enough that the rear portion could be the rigid support while the front portion is the flexible abrasive matrix. Conversely, the combination could be of three or more layers comprising a rigid backing, an intermediate soft, spongy pad and an outer thin sheet of abrasive.

An advantage of the combination rigid support and flexible abrasive matrix is that, as the abrasive surface wears away or ablates, fresh abrasive is exposed.

Although the sharpener 10 is shown and described as having a disc sharpening member, other forms of sharpening members such as sharpening structures using drums or using abrasive belts, etc. could be used.

When combining the function of sharpening both metallic and ceramic blades in a sharpener as envisioned in this invention, it became clear that the swarf created by sharpening the ceramic blades may abrade the blade surface of metallic knives, when they share sharpening stages, as for example the common finishing stage. This would occur because ceramic swarf is much harder than the metal alloy used for the typical steel blades. Therefore if a metal blade were to come in contact with the guide surfaces of the finishing stage, subsequent to a ceramic blade having been sharpened in that stage, the possibility exists that the surface of the metal blade could be slightly abraded.

To minimize that possibility, the inventors designed a removable guide to permit the cleaning of the guide surfaces in order to remove ceramic or any other swarf from the guide surfaces.

The cleaning of the guide surfaces could be accomplished with a vacuum device, a moist cloth, adhesive tape or other similar methods or combinations of methods.

Figure 8:
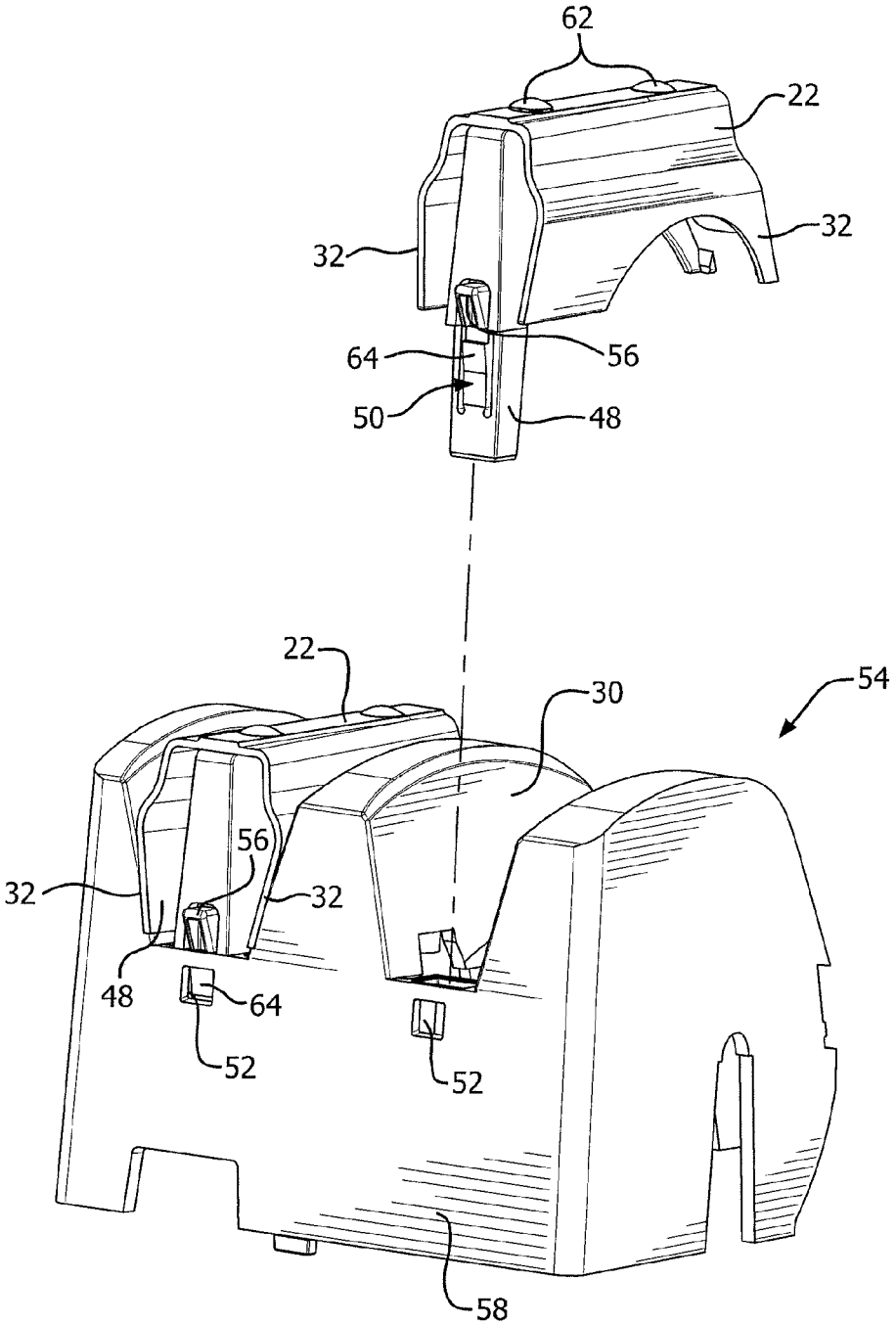
FIG. 8 is an assembly view of a module containing the guide structure usable in the sharpener of FIGS. 1-7.
Figure 9:
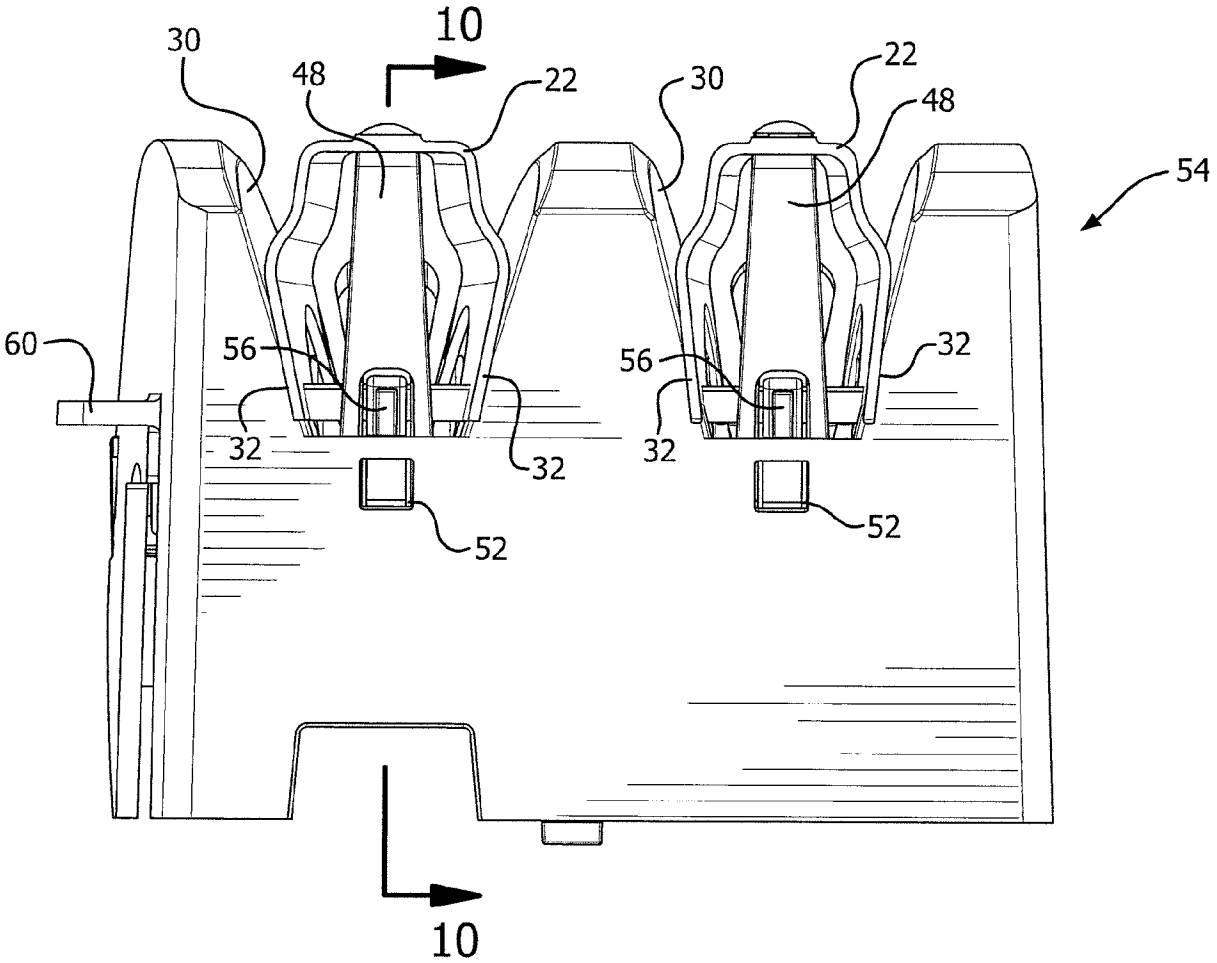
FIG. 9 is a front elevational view of the module shown in FIG. 8.
Figure 10:
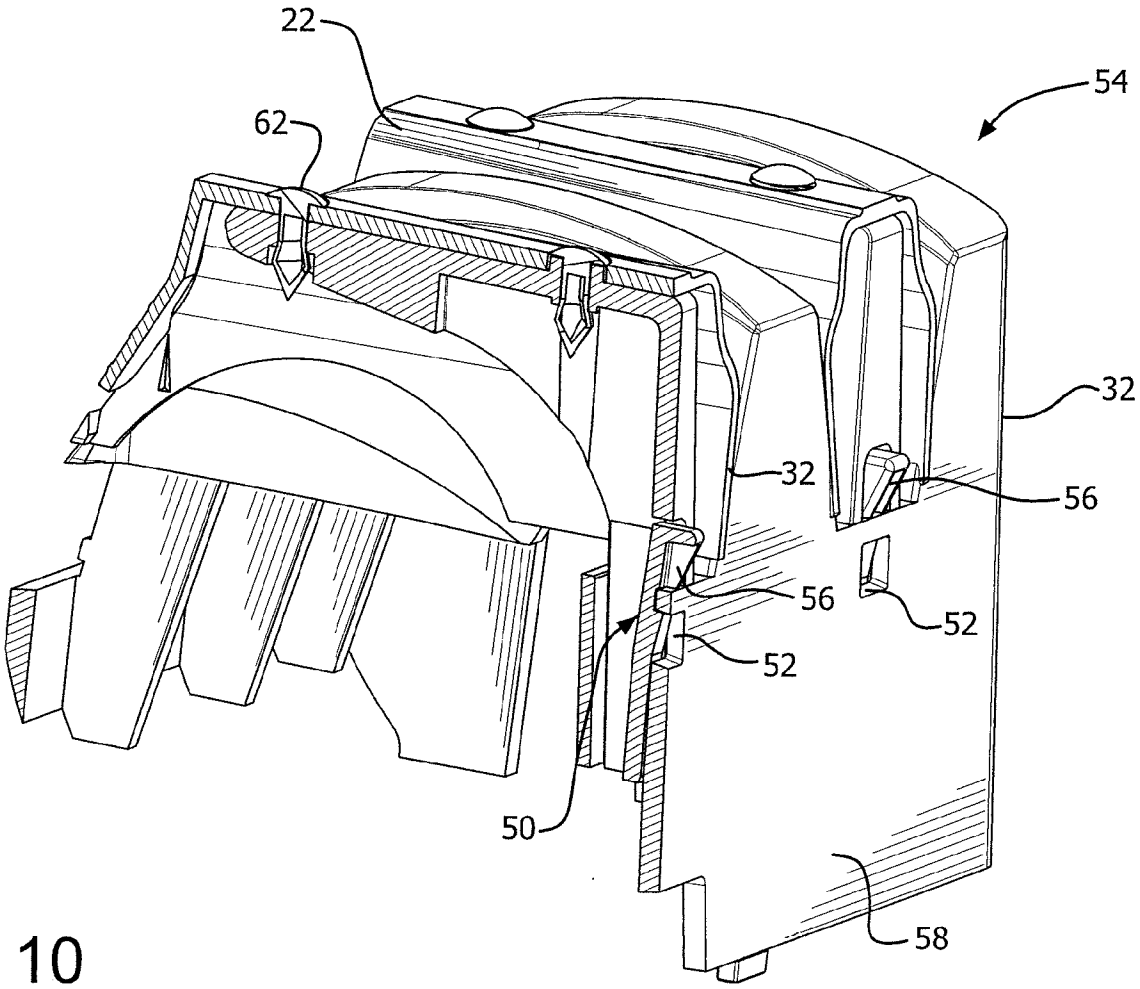
FIG. 10 is a cross-sectional view taken through FIG. 9 along the line 10-10.

One version of this removable guide is shown in FIGS. 8-10 where the spring knife guides 22 of the current invention are attached to a post 48 which contains a molded-in plastic spring member 50 designed to fit into a channel 52 of the sharpening module 54 that properly locates the spring knife guide 22. The removal of this post 48 and spring knife guide assembly 22 is done by pressing on the protruding spring release button 56 lifting the assembly up and away from the sharpening module 54.

Although this invention can be most effectively used in the finishing stage, which is typically shared by metallic and ceramic blades, it could be used in all stages of the sharpener.

The benefits of this invention span beyond just the ability to clean the guide surfaces. For example, alternate guides could be developed with capabilities to sharpen a wider variety and geometries of blades, including but not limited to very thick blades, very thin blades, hollow ground blades and others. These alternate guides could be provided as accessories to the sharpener of this invention.

Another benefit is the application of this concept to the repair and maintenance of the sharpener. Since these guide surfaces are high wear areas, consumers that damage these guides by excessive use can easily purchase and replace these guides, without the need to return the sharpener to the manufacturer for repair.

Although this invention has focused on the use of this removable blade guide for the dual use sharpener for metallic and ceramic blades, it can similarly be applied to a sharpener designed exclusively for metal knives or other cutting instruments. Since metal alloys vary in hardness based on the components of the alloy and how it was heat treated, the swarf generated by sharpening harder metal blades, could abrade the surface of softer metal blades that are subsequently sharpened in the sharpener.

FIGS. 8-10 show one embodiment for practicing the concept of this invention which involves being able to move the guide member from its guiding position during use of the sharpener to an exposed position where the guide member, such as spring 22, could be readily cleaned. In addition, by removing the guide member from the sharpening or pre-sharpening stage there is access to that stage to facilitate cleaning or other maintenance of the stage.

As shown in FIGS. 8-10 the sharpening module 54 is intended to be used for stages 2 and 3 of sharpener 10. A similar module could be used for stage 1, if desired. Module 54 has its various walls 58 structured and shaped to fit in the upper cover portion 26 of sharpener 10 at the appropriate sharpening stages. As illustrated in FIG. 9 a tab or flange 60 extends outwardly from module 54 for securement to a fixed portion of the sharpener in any suitable manner. Module 54 also includes the appropriate sharpening members or discs.

As illustrated spring 22 is attached to post 48 in any suitable manner, such as by fasteners 62. Spring member 50 includes two outwardly extending projections. One of these projections at the free end of spring member 50 is a release button 56. Another projection below release button 56 is locking button 64. As best shown in FIG. 8 when the assembly of spring 22 and post 48 is moved downwardly locking button 64 enters the hole or channel 52 formed in wall 58 of module 54. This locks the spring 22 and post 48 in position so that the spring guide arms 32 are disposed on each respective side of the pair of discs 36,36 and 38,38 in the stage 2 and stage 3 portions of the sharpener. When it is desired to remove the spring 22 from the appropriate stage release button 56 is pressed inwardly toward post 48. This inward movement causes locking button 56 to be removed from channel 52 and the post 48 and spring 22 can be removed by an upward motion.

Although the inventors have focused on the specific construction of this removable guide, alternative methods of a removable guide could be envisioned. For example, instead of a molded in plastic spring release, an alternate device could use a metal spring release.

Alternatively, an external screw could hold the guide post in place, and the user could release or replace the guide by loosening or tightening the screw.

Other alternatives could be a slide type system where the guide 22 slides into a post by a "dovetail" arrangement. Further attaching/detaching alternatives for the guide include magnets and Velcro (hook/loop).

A further alternative could be one where the guide 22 is flipped, using a hinge arrangement away from its position to permit cleaning of the guide surfaces.

What is claimed is:

1. In a sharpener for sharpening ceramic blades wherein the sharpener has at least one stage, each stage having at least one rotatable disc with an abrasive surface and having guide structure for guiding a knife blade with its facet against the rotating disc, the improvement being in that the stage is a finishing stage which simultaneously sharpens and polishes the blade facet, said disc in said finishing stage being in the form of a rigid support having a soft resilient polymer matrix containing ultra-hard abrasive particles to sharpen/polish the blade facet, and the abrasive particles in said matrix having a grit size of 180-2000 grit.

2. The sharpener of claim 1 wherein said rigid support and said abrasive matrix comprise a two layer combination.

3. The sharpener of claim 1 including a ceramic blade pre-sharpening stage having a rotatable disc with an abrasive surface and having guide structure, the abrasive surface of said ceramic blade pre-sharpening stage having abrasive particles in the range of 200-1200 grit.

4. The sharpener of claim 3 including a metal blade pre-sharpening stage having a rotatable disc with an abrasive surface and having guide structure, the abrasive surface on the disc in said metal blade pre-sharpening stage having abrasive particles in the range of 100-600 grit.

5. The sharpener of claim 4 wherein said discs in said ceramic blade pre-sharpening stage and in said finishing stage are mounted on a common shaft which is rotated by a motor, said disc in said metal blade pre-sharpening stage being mounted on a separate shaft offset from said common shaft, and both of said common shaft and said separate shaft being driven by the same motor.

6. The sharpener of claim 1 wherein said abrasive particles are harder than the hardness of ceramic, and the matrix having a Rockwell hardness with a recovery range of 38% to 48%.

7. The sharpener of claim 1 wherein said finishing stage has guide structure including a guide member having a guide surface against which the blade would be placed, said guide member having a guiding position during use of the sharpener and said guide member being selectively movable to an exposed position away from said guiding position to provide access to said guide member.

8. The sharpener of claim 7 wherein said guide member is a spring having a spring arm against which the blade would be placed, said spring being mounted to a post, a spring member mounted to said post, a locking button on said spring member, and said locking button being selectively movable into and out of a channel to selectively lock said guide member in its guiding position and permit said guide member to be moved to said exposed position.

9. The sharpener of claim 8 wherein said spring member includes a release button at its free end for selectively moving said locking button into and out of said channel.

10. The sharpener of claim 9 including a sharpening module located in said finishing station, said finishing station having a pair of discs, said post and said guide member being mounted in said module, said spring being an inverted U-shaped spring for having two of said spring arms each of which is located near one of said finishing station discs, and said module being detachably mounted in said sharpener.

11. The sharpener of claim 10 wherein said sharpener is a multi-stage sharpener having a first pre-sharpening stage for sharpening metal blades and a second pre-sharpening stage for sharpening ceramic blades in addition to said finishing stage, and each of said stages having a respective one of said guide members selectively movable to a guiding position and to an exposed position.

12. In a sharpener for sharpening the blade of a cutting instrument wherein the sharpener includes a sharpening member and guide structure, said guide structure including a guide member having a guide surface against which the blade may be placed to guide the blade against the sharpening member, the improvement being in that said guide member has a guiding position during use of the sharpener, and said guide member being selectively movable to an exposed position away from said guiding position to provide access to said guide member, and said guide member being mounted on a post which is selectively moveable to and from said guiding position and said exposed position.

13. The sharpener of claim 12 wherein said exposed position is a position wherein said guide member is completely removed from the sharpener.

14. The sharpener of claim 12 wherein said post includes a spring member, a locking button on said spring member, and said locking button being selectively located in a channel in a wall of said sharpener to selectively lock said guide member in said guiding position and to permit said guide member to be removed away from said guiding position to said exposed position.

15. The sharpener of claim 14 wherein said spring member includes a release button at its free end to selectively move said locking button into and out of said channel.

16. The sharpener of claim 15 including a module detachably mounted to a portion of said sharpener, said guide member being mounted to said module in said guiding position, and said module having a wall which contains said channel.

17. The sharpener of claim 16 wherein said guide member is an inverted U-shaped spring having two spring arms, each of said spring arms being located on a side of said post and each of said spring arms having a guide surface, said sharpener including two rotatable discs as said sharpening member, and each of said rotatable discs being disposed at one of said respective spring arms.

18. The sharpener of claim 17 wherein said sharpener is a multi-stage sharpener including two sharpening stages, and said module being a common module over both of said sharpening stages.

19. The sharpener of claim 16 wherein said sharpening member is mounted to said module.

20. The sharpener of claim 19 wherein said sharpening member comprises a disc in the form of a rigid support having a soft resilient polymer matrix containing ultra-hard abrasive particles, and said abrasive particles having a grit size of 180-2000 grit.

21. A method of sharpening a ceramic blade knife comprising providing the sharpener of claim 3, sharpening a ceramic knife blade by pre-sharpening the ceramic knife blade in the ceramic blade pre-sharpening stage, and then moving the blade to the finishing stage to sharpen and polish the blade.

22. The method of claim 21 for selectively sharpening ceramic knife blades and metallic knife blades in a single sharpener comprising providing the sharpener of claim 3, sharpening a ceramic knife blade by pre-sharpening the ceramic knife blade in only the pre-sharpening ceramic stage and then placing the ceramic knife blade in the finishing stage to sharpen and polish the ceramic knife blade, and sharpening a metallic knife blade by pre-sharpening the metallic knife blade using only the metallic pre-sharpening stage and then placing the metallic knife blade in the finishing stage to sharpen and polish the metallic knife blade.

23. In a method of cleaning a stage in a sharpener for the blade of a cutting instrument wherein the sharpener has at the stage at least one sharpening member and guide structure, the guide structure including a guide member, the improvement being in providing the sharpener of claim 12, mounting the guide member in a guiding position to be in the guiding position during use of the sharpener, and moving the guide member out of the guiding position to an exposed position to provide access to the guide member.

24. The method of claim 23 wherein the sharpener is the sharpener of claim 15, including the steps of moving the post downwardly until the locking button enters a channel to lock the guide member in the guiding position, pressing the release button inwardly until the locking button is moved out of the channel, and lifting the post upwardly to remove the post and locking member out of the sharpener to the exposed position.

* * * * *